US008083001B2

(12) United States Patent
Conner et al.

(10) Patent No.: US 8,083,001 B2
(45) Date of Patent: Dec. 27, 2011

(54) EXPANDABLE GAGE RING

(75) Inventors: Nicholas S. Conner, Cypress, TX (US); Frank J. Maenza, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 12/548,643

(22) Filed: Aug. 27, 2009

(65) Prior Publication Data

US 2011/0048744 A1 Mar. 3, 2011

(51) Int. Cl.
*E21B 33/128* (2006.01)

(52) U.S. Cl. ..... 166/387; 166/196; 166/118; 277/340

(58) Field of Classification Search ..... 166/387, 166/118, 134, 196; 277/338, 339, 340
See application file for complete search history.

(56) References Cited

U.S. PATENT DOCUMENTS

| | | | | |
|---|---|---|---|---|
| 180,169 | A * | 7/1876 | Tasker | 279/2.13 |
| 2,966,216 | A * | 12/1960 | Bigelow | 166/134 |
| 4,311,196 | A * | 1/1982 | Beall et al. | 166/134 |
| 4,852,394 | A | 8/1989 | Goans | 73/49.8 |
| 6,598,672 | B2 | 7/2003 | Bell et al. | 166/118 |
| 7,387,158 | B2 | 6/2008 | Murray et al. | 166/196 |
| 2007/0131413 | A1 * | 6/2007 | Millet et al. | 166/115 |

* cited by examiner

*Primary Examiner* — Giovanna Wright
*Assistant Examiner* — Richard Alker
(74) *Attorney, Agent, or Firm* — Shawn Hunter

(57) ABSTRACT

A gage ring assembly to provide support to an anti-extrusion containment ring in a packer device including a compression ring and a plurality of interlocking arcuate segments which form a substantially unbroken support wall when in a set condition. A first set of segments each have a wedge-shaped body that is wider at a proximal axial end than it is at its distal axial end. A second set of segments preferably each have a wedge-shaped body wider at its distal axial end than it is at its proximal axial end.

19 Claims, 6 Drawing Sheets

EXPANDABLE GAGE RING

BACKGROUND OF THE INVENTION

1. Field of the Invention

The present invention generally relates to the design of axial containment systems for packer devices.

2. Description of the Related Art

Packers are used to form fluid seals between an inner tubular string and an outer tubular string which radially surrounds the inner tubular string. A common form of packer device is a "squeeze" type packer wherein an elastomeric packer element is axially compressed in order to cause it to expand radially outwardly and into sealing contact with the surrounding tubular member.

When used at great depths, where there are high temperatures and pressures, the elastomeric elements used in packers begin to break down. As a consequence, the elastomer may extrude and bleed out into the area between the packer and the surrounding tubular. If the elastomeric element extrudes out excessively, the sealing capability of the packer device will be destroyed.

Containment devices are used to try to prevent undesirable extrusion of the elastomeric element. Usually, the containment device consists of a pair of anti-extrusion containment rings that are located on each axial side of the elastomeric element. Typically, these rings are formed of a solid material that, while more rigid than the elastomeric element, will deform and at least partially envelop the axial ends of the elastomeric element during all stages of packer operation.

SUMMARY OF THE INVENTION

The invention relates to the construction of packer devices as well as gage ring back-up arrangement used with packer devices. In particular aspects, the present invention provides a gage ring that is used to provide support to an anti-extrusion containment ring in a packer device. In a currently preferred embodiment, the gage ring includes a compression ring and a plurality of interlocking arcuate segments. A first set of segments each have a wedge-shaped body that is wider at a proximal axial end than it is at its distal axial end. A second set of segments preferably each have a wedge-shaped body wider at its distal axial end than it is at its proximal axial end. The first and second arcuate segments are disposed radially around a central mandrel for the packer device in an alternating fashion such that a first segment is disposed between each two of the second segments and vice versa. In a preferred embodiment, the first and second segments are interlocked with one another by a tongue-in-groove type connection which permits the first and second segments to slide axially with respect to each other while maintaining the segments in radial alignment with each other.

The packer and gage ring assemblies are set by axial movement of a compression member. During setting, the first segments are moved through sliding action from the tongue-in-groove arrangement in between the second segments. All of the segments are collectively displaced radially outwardly as this occurs so that the gage ring assembly presents a larger diameter than in the unset condition. In the set condition, the distal end surfaces of both the first and second segments provide a substantially unbroken support wall for an adjacent packer containment ring.

The gage ring assembly can be unset and returned to a radially reduced condition by moving the compression member axially away from the packer element. This movement will withdraw the first segments from in between the second wedge members, thereby permitting all of the segments to move radially inwardly with respect to the mandrel.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
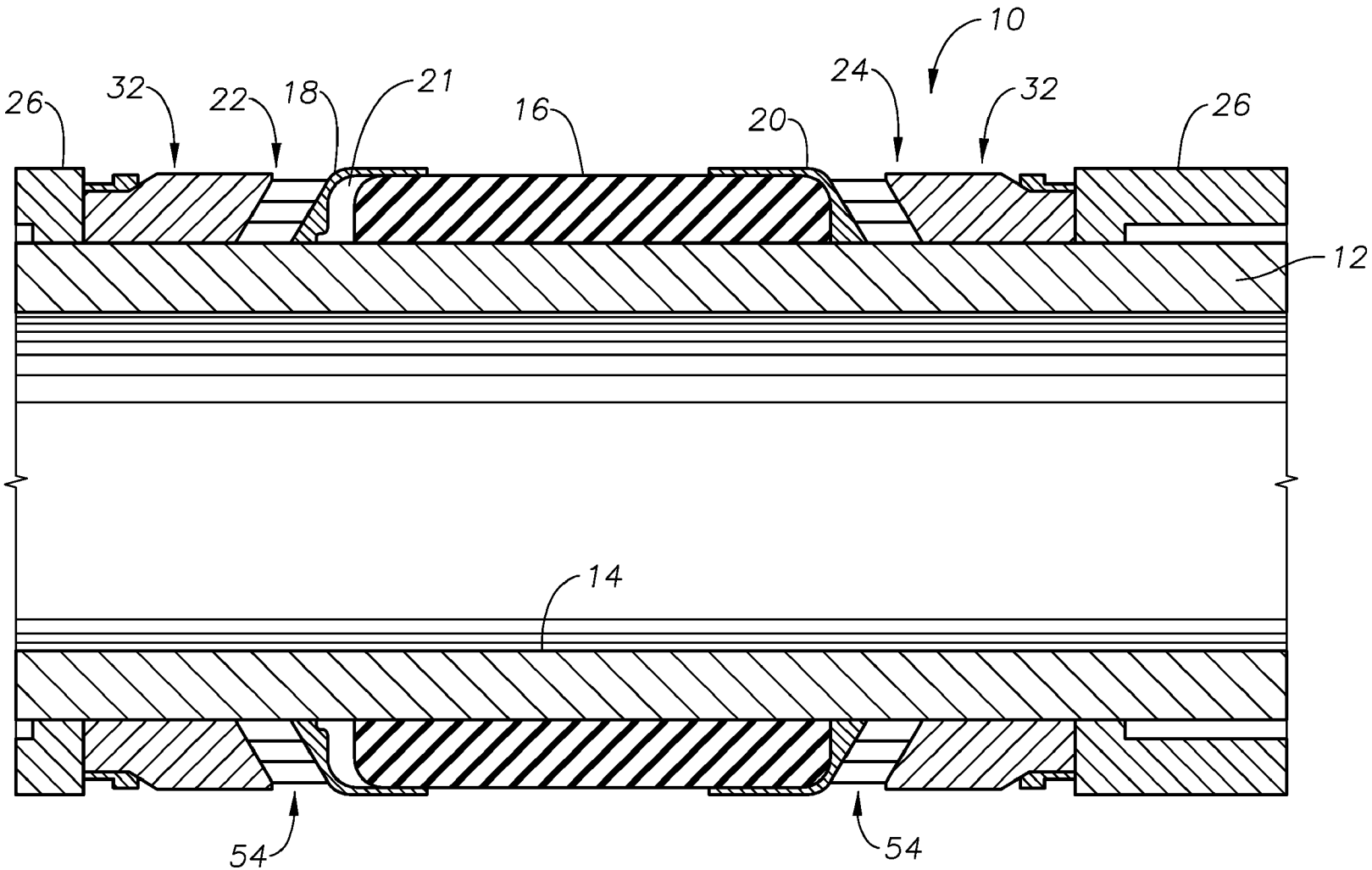
FIG. 1 is a side, cross-sectional view of an exemplary packer device constructed in accordance with the present invention and in an unset condition.
Figure 2:
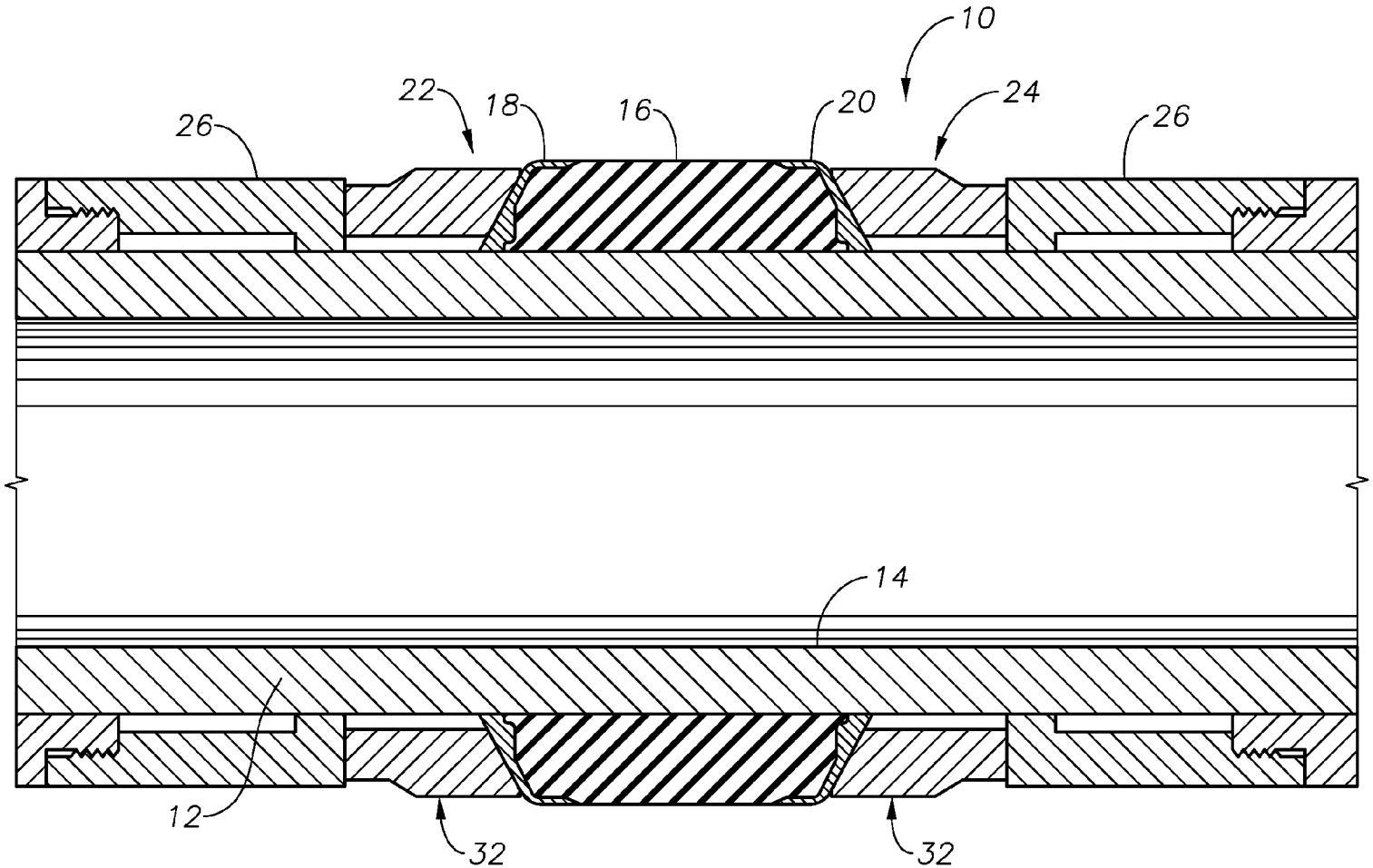
FIG. 2 is a side, cross-sectional view of the packer device shown in FIG. 1, now in a set condition.

FIGS. 1-8 illustrate an exemplary packer device 10 of the type that is incorporated into a hydrocarbon production tubing string or other work string that is disposed into a wellbore. Packers are well known devices that are used to form a fluid seal between an interior tubular string and an external tubular string. Packer devices are described, for example, in U.S. Pat. No. 7,387,158 by Murray et al. This patent is owned by the assignee of the present application and is herein incorporated by reference.

The packer device 10 includes a central tubular mandrel 12 which defines a flowbore 14 along its length. An elastomeric packer element 16 radially surrounds the mandrel 12. Annular metallic containment rings 18, 20 are located on each axial side of the packer element 16. The containment rings 18, 20 are preferably slightly elastically deformable and each is formed to envelop or partially envelop the respective axial end of the packer element 16. It is noted, with reference to FIGS. 1 and 5, that there is a gap 21 located between the packer element 16 and the containment ring 18.

Gage ring assemblies, generally shown at 22 and 24, surround the mandrel 12 and lie axially outside of the containment rings 18, 20. In the depicted embodiment, the gage ring assemblies 22 and 24 are substantially identical to one another in terms of construction and operation. Therefore, a description of the construction and operation of one gage ring assembly will serve to describe both gage ring assemblies 22, 24. The gage ring assemblies 22, 24 each include an annular compression ring 26 which radially surrounds the central mandrel 12. In usual operation, one of the compression rings 26 is affixed to the mandrel 12. The other compression ring 26 is axially moveable with respect to the mandrel 12. The compression ring 26 may be moved by means of a hydraulic setting arrangement (not shown), of a type known in the art, or in other ways known in the art. Preferably, the compression rings 26 each present a plurality of generally T-shaped projections 28 (see FIGS. 3-5) which extend axially from an annular base portion 30.

Figure 3:
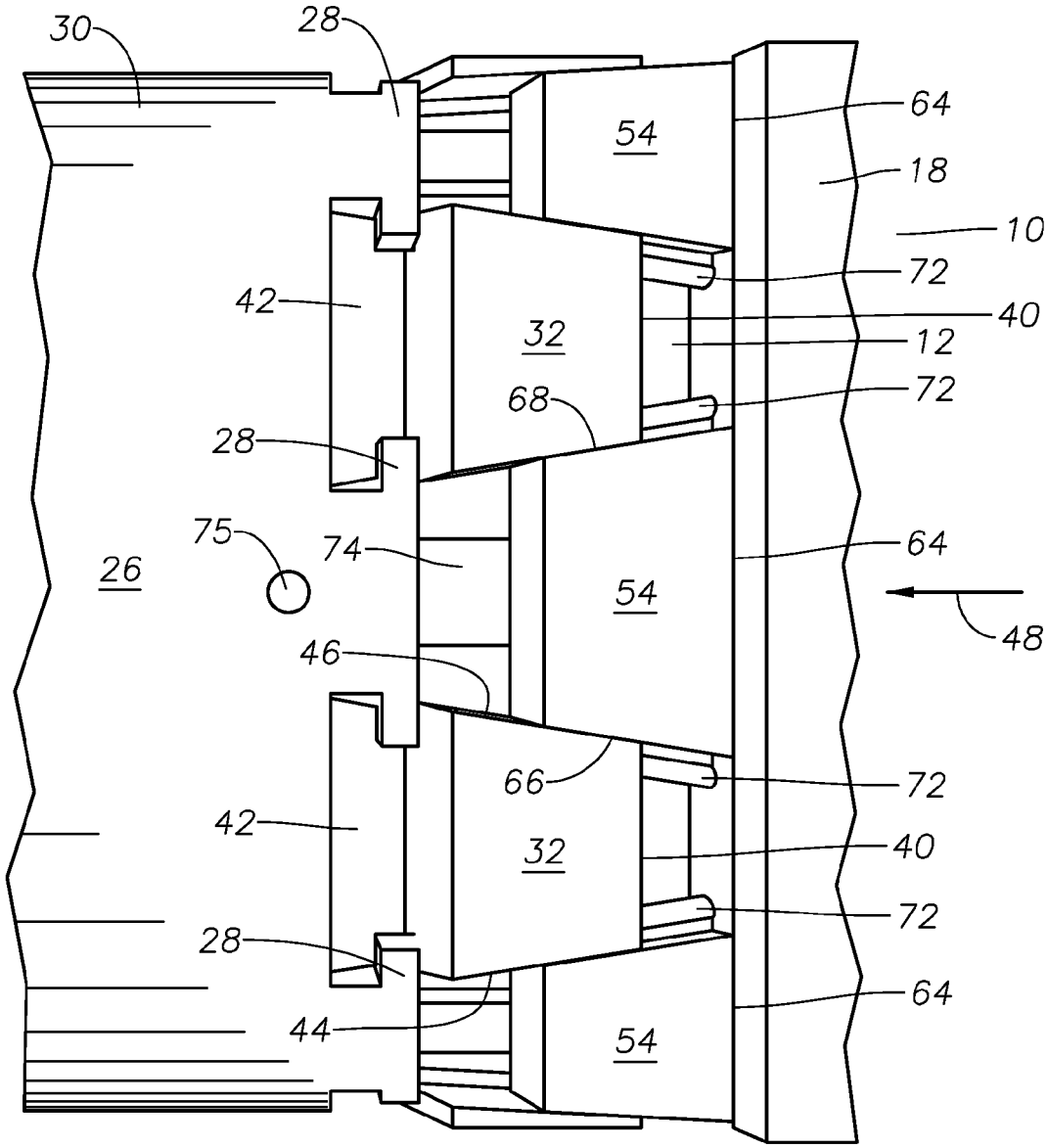
FIG. 3 is a side, external view of a portion of the packer device shown in FIGS. 1 and 2, in an unset position.
Figure 4:
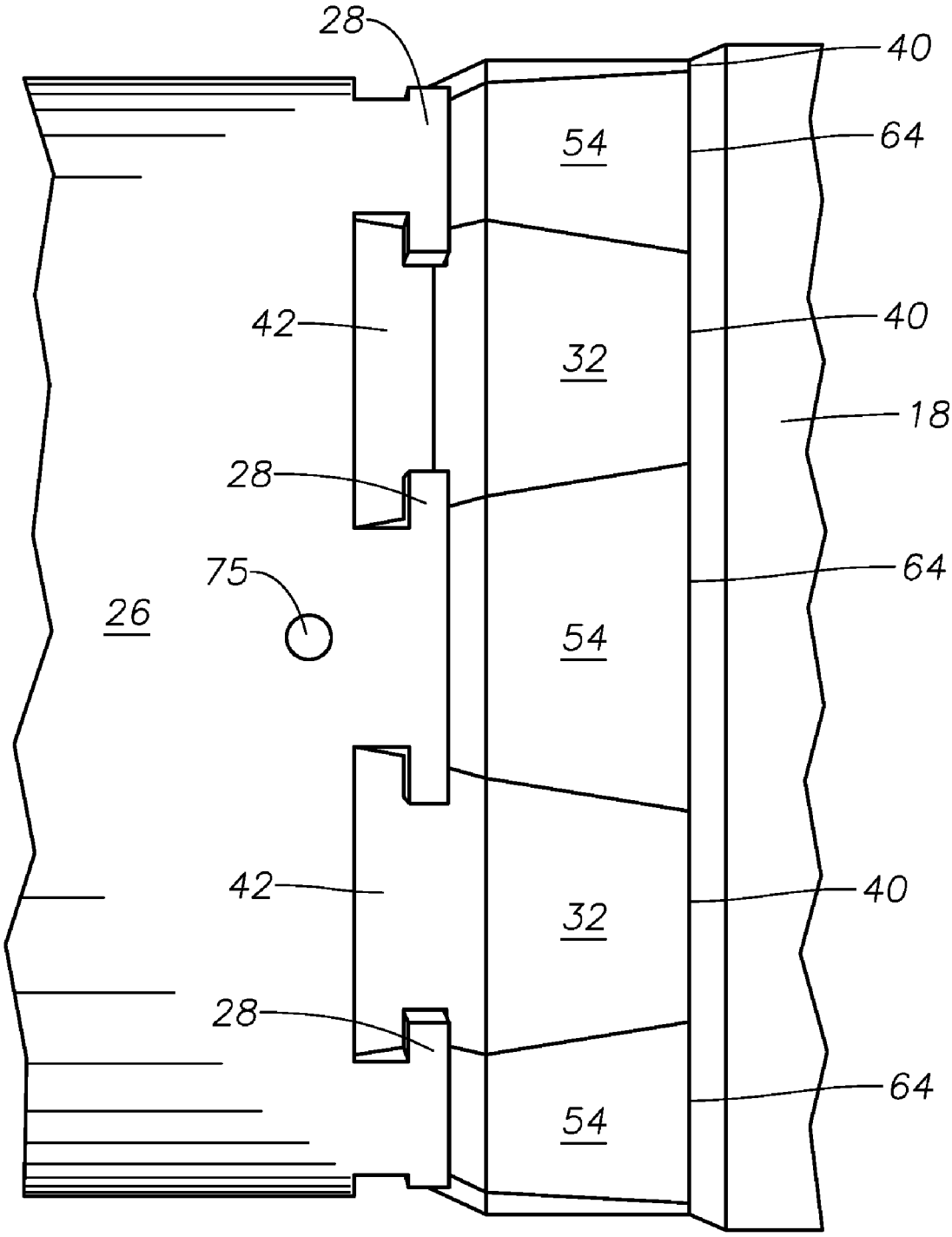
FIG. 4 is a side, external view of a portion of the packer device portions shown in FIG. 3, now in a fully set condition.
Figure 7:
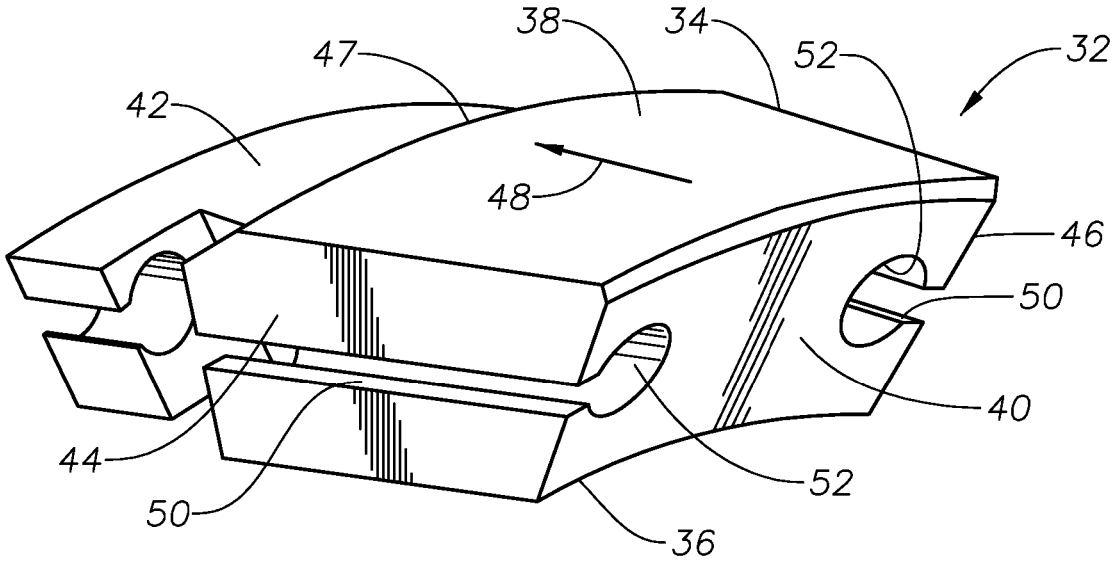
FIG. 7 is an external isometric view of an exemplary first segment used in the gage ring assembly of the packer device and shown apart from the other components.

The gage ring assemblies 22, 24 each include a first set of arcuate segments 32. A single segment 32 is depicted in FIG. 7 apart from the other components of the gage ring assemblies 22, 24. As seen there, the segment 32 includes a substantially wedge-shaped body 34 having a radially inner surface 36 and a radially outer surface 38. Both the inner and outer surfaces 36, 38 are arcuately curved to generally match the curvature of the desired expanded gage diameter. The segment body 34 also presents a curved distal end support surface 40 that is canted radially inwardly to generally conform to the shape of the containment ring 18 or 20 that it is adjacent to. The opposite, proximal end of the wedge member body 34 presents a generally T-shaped projection 42 which is formed to be complimentary to the projections 28 of the compression ring 26. As can be seen in FIGS. 3-4, the projections 42 of the segments 32 are interlocked with the projections 42 of the compression ring 26 so that axial movement of the compression ring 26 will move the segments 32 axially in concert with the compression ring 26. The body 34 also presents first and second side walls 44, 46 which diverge from each other in a first axial direction which is indicated by arrow 48, thereby providing the wedge-like shape. As a result, the proximal end 47 of the body 34 is wider than the distal end (i.e., the end proximate surface 40). Linear grooves 50 and enlarged openings 52 are formed within each side wall 44, 46.

Figure 8:
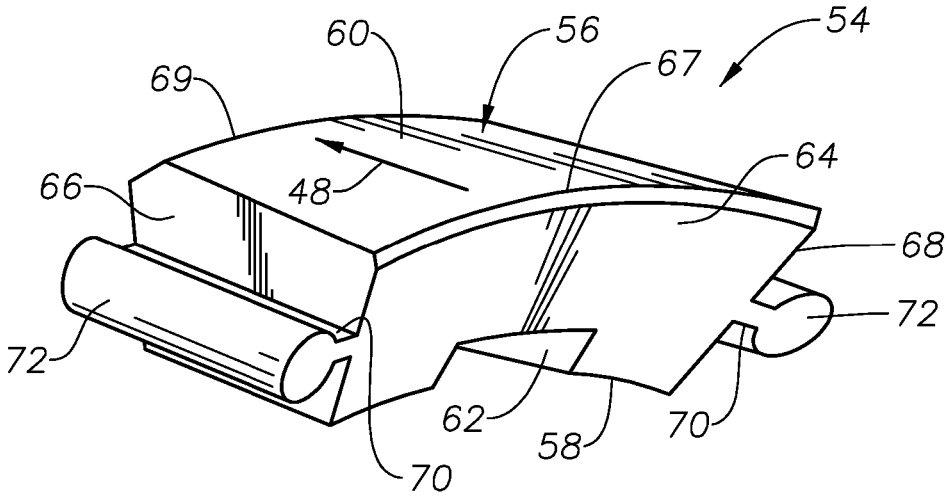
FIG. 8 is an external isometric view of an exemplary second segment used in the gage ring assembly of the packer device and shown apart from the other components.

The gage ring assemblies 22, 24 also include a second set of arcuate segments 54. FIG. 8 depicts a single segment 54 apart from the other components of the gage ring assemblies 22, 24. The segments 54 each include a body 56 having a radially inner surface 58 and a radially outer surface 60. Both the inner and outer surfaces 58, 60 are arcuately curved to generally match the curvature of the desired expanded gage diameter. A notch 62 is formed into the inner surface 58. The body 56 presents a curved distal support surface 64 which is canted radially inwardly to generally conform to the shape of the containment ring 18 or 20 that it is adjacent to. The body 56 also presents first and second side walls 66, 68 which converge toward one another in the axial direction indicated by arrow 48. As a result, the distal end 67 of the body 56 is wider than the proximal end 69, providing the body 56 with a wedge-like shape. Flanges 70 extend outwardly from each side wall 66, 68 and terminate in enlarged cylindrical tabs 72 which match the profile of the enlarged openings 52 of segments 32. It is noted that, while the tabs 72 are shown and described as being cylindrical, this is an exemplary embodiment only. The tabs 72 may have many different geometries, including cross-sections that are rectangular, triangular, oval, diamond-shaped, and so forth, so long as they match the geometrical form of the enlarged openings 52 in a complimentary fashion.

Figure 5:
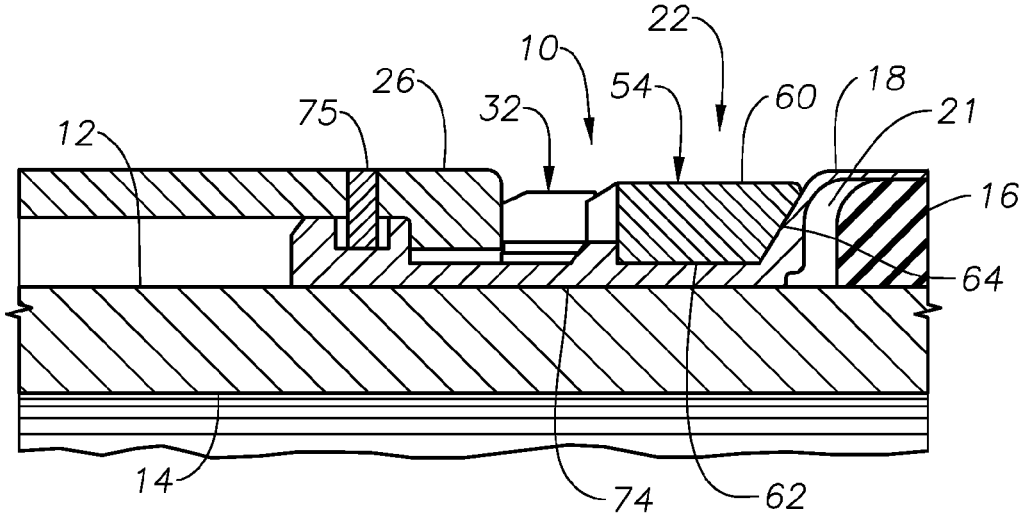
FIG. 5 is an enlarged, one-quarter cross-sectional view of the packer device portions shown in FIGS. 3-4 in an unset condition.
Figure 6:
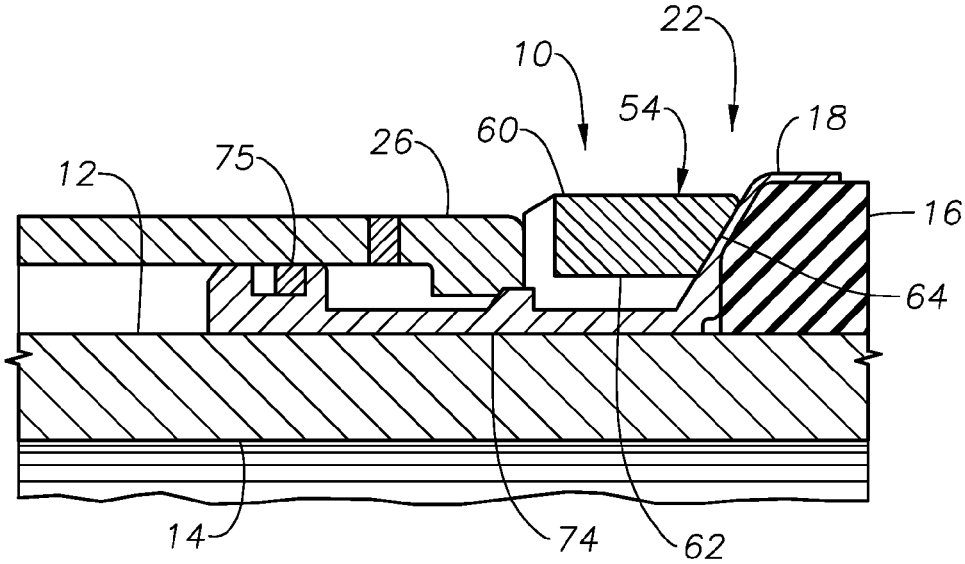
FIG. 6 is an enlarged, one-quarter cross-sectional view of the packer device portions shown in FIG. 5, now in a set condition.

As can best be seen in FIGS. 3, 5 and 6, linear tracks 74 are disposed upon the mandrel 12 and underlie each of the segments 54. The tracks 74 reside within the notch 62 of the segments 54. The segments 54 are not connected or affixed to the tracks 74. However, a shear pin 75 releasably secures the compression ring 26 to at least one of the tracks 74. The first segments 32 and the second segments 54 are disposed about the mandrel 12 in an alternating fashion such that a first segment 32 is disposed in between each two of the second segments 54. In addition, the enlarged tabs 72 of the segments 54 are located within the openings 52 of neighboring segments 32 so that a tongue-in-groove sliding interface is provided between each of the first and second segments 32, 54. When the segments 32, 54 are axially moved with respect to each other so that their distal surfaces 40, 64 are aligned with each other (see FIG. 4), the divergence of the side walls 44, 46 of segments 32 will cause neighboring segments 54 to be urged apart from each other.

In operation, the gage ring assemblies 22 and 24 provide structural support to the containment rings 18, 20. During setting of the packer device 10, a setting force is applied to the compression ring 26 using means known in the art. The shear pin 75 is ruptured, and the compression ring 26 is moved axially with respect to the mandrel 12 toward the packer element 16. The gap 21 between the containment ring 18 and the packer 16 is closed. The first segments 32 are then moved in between the second segments 54 so that the diverging side walls 44, 46 of the segments 32 will slide against the side walls 68, 66, respectively of the segments 54. The segments 32 and 54 are both physically displaced radially outwardly and away from the inner mandrel 12, as depicted in FIG. 6. As FIG. 4 illustrates, the distal surfaces 40 of the segments 32 and the distal surfaces 64 of the segments 54 form a substantially unbroken distal support wall that supports the respective containment ring 18 or 20. It is also noted that, when the gage ring assemblies 22, 24 are in their reduced diameter condition (FIG. 3), the distal support wall is broken, as there are radial gaps between the distal surfaces 64 of the segments 54.

It is noted that the gage ring assemblies 22, 24 are moveable between a reduced diameter condition (when not set) and an enlarged diameter condition (when set). As can be seen with reference to FIGS. 5 and 6, the segments 54 are moved radially outwardly from the mandrel 12 such that the diameter presented by the outer radial surface 60 of the segments 54 is greater than that of the compression ring 26.

When the packer device 10 is run into a surrounding wellbore, the packer device 10 is in an unset position wherein the packer element 16 is at a reduced diameter condition. Also, the gage ring assemblies 22, 24 are in a reduced diameter condition. However, when the packer device 10 is set, the segments 32 and 54 orient themselves through a compressive load from the compression ring 26 to a final, expanded diameter condition gage ring that is greater than the reduced diameter condition. Further, the expanded diameter of the gage rings 22, 24, when so set, is greater than the diameter of the containment rings 18, 20. The inventors have found that the ability of the gage ring assemblies 22, 24 to expand in this manner is advantageous in that, when the gage ring assemblies 22, 24 are expanded radially, to a larger diameter than the compression ring 26, they provide superior support to the containment rings 18, 20.

Unsetting the packer device 10 is done by moving the compression ring 26 axially away from the packer element 16 upon the mandrel 12. As the compression ring 26 is moved away from the packer element 16, the first set of segments 32 are pulled axially away from the segments 54 allowing the gage ring assemblies 22, 24 to return to their reduced diameter condition.

Those of skill in the art will recognize that numerous modifications and changes may be made to the exemplary designs and embodiments described herein and that the invention is limited only by the claims that follow and any equivalents thereof.

What is claimed is:

1. A gage ring assembly for support of a containment ring in a packer device having a central mandrel and an axially compressible packer element surrounding the mandrel, the gage ring assembly comprising:

a plurality of first arcuate segments disposed radially around the mandrel, the first segments each comprising a body having:

a support surface for supporting the containment ring; diverging side surfaces;

a plurality of second arcuate segments disposed radially around the mandrel, the second segments each presenting a support surface for supporting the containment ring; and wherein the first and second arcuate segments are disposed in an alternating manner about the mandrel such that a first arcuate segment is located between each two of the second arcuate segments;

the first and second arcuate segments being axially moveable relative to each other so that the diverging side surfaces of the first segments urge the second segments apart from each other and cause the first and second segments to move radially outwardly; and wherein the first and second segments are moveable to set position wherein the support surfaces of the first and second segments are aligned to the set position to form a substantially unbroken support wall for the containment ring.

2. The gage ring assembly of claim 1 wherein the first and second arcuate segments are interconnected with an adjacent arcuate segment by a sliding interface.

3. The gage ring assembly of claim 2 wherein the sliding interface comprises a tongue-in-groove arrangement.

4. The gage ring assembly of claim 1 further comprising:

a notch formed within a radially inner surface of at least one of said first or second arcuate members; and a linear track that resides within the notch.

5. The gage ring assembly of claim 1 further comprising a compression ring radially surrounding the mandrel and axially moveable upon the mandrel, the compression ring being affixed to the plurality of first arcuate segments.

6. The gage ring assembly of claim 5 wherein the first and second segments, in the set position, provide a diameter that is larger than that of the compression ring.

7. The gage ring assembly of claim 1 wherein the second segments present converging side surfaces.

8. A packer device comprising:

a central mandrel;

an axially-compressible packer element radially surrounding the mandrel;

a containment ring radially surrounding the mandrel and axially moveable with respect to the mandrel and at least partially containing an axial end of the packer element;

a gage ring assembly to support the containment ring, the gage ring assembly comprising:

a) a plurality of first arcuate segments disposed radially around the mandrel, the first segments each comprising a body having a support surface for supporting the containment ring and divergent side surfaces;

b) a plurality of second arcuate segments disposed radially around the mandrel, the second segments each presenting a support surface for supporting the containment ring;

c) the first and second segments being axially moveable relative to each other so that the diverging side surfaces of the first segments urge the second segments apart from each other and cause the first and second segments to move radially outwardly; and d) wherein the first and second segments are moveable to a set position wherein the support surfaces of the first and second segments are aligned to form a substantially unbroken support wall for the containment ring.

9. The packer device of claim 8 wherein the first and second arcuate segments are interconnected with an adjacent arcuate segment by a sliding interface.

10. The packer device of claim 9 wherein the sliding interface comprises a tongue-in-groove arrangement.

11. The packer device of claim 8 further comprising:

a notch formed within a radially inner surface of at least one of said first or second arcuate members; and a linear track that resides within the notch.

12. The packer device of claim 8 further comprising a compression ring radially surrounding the mandrel and axially moveable upon the mandrel, the compression ring being affixed to the plurality of first arcuate segments.

13. The packer device of claim 12 wherein the first and second segments, in the set position, provide a diameter that is larger than that of the compression ring.

14. The packer device of claim 8 wherein the containment ring is at least partially elastically deformable.

15. A method of providing support for a packer containment ring in a packer device having a central mandrel, an axially-compressible packer element, a containment ring radially surrounding the mandrel and axially moveable with respect to the mandrel and at least partially containing an axial end of the packer element, the method comprising the steps of:

providing a gage ring assembly upon the mandrel proximate the containment ring, the gage ring assembly having:

a) a plurality of first arcuate segments disposed radially around the mandrel, the first segments each comprising a body having a support surface for supporting the containment ring and divergent side surfaces;

b) a plurality of second arcuate segments disposed radially around the mandrel, the second segments each presenting a support surface for supporting the containment ring;

axially moving the first segments relative to the second segments to a set position so that the diverging side surfaces of the first segments urge the second segments apart from each other and cause the first and second segments to move radially outwardly and in support of the containment ring, and wherein the support surfaces of the first segments and the support surfaces of the second segments are aligned to form a substantially unbroken wall when in the set position.

16. The method of claim 15 wherein the first segments are moved axially by movement of a compression ring that is affixed to each of the first segments.

17. The method of claim 15 wherein the first and second segments further provide a set gage ring having a diameter that is greater than that of the containment ring.

18. The method of claim 16 further comprising the step of unsetting the gage ring assembly by moving the compression ring axially upon the mandrel.

19. The method of claim 15 wherein the step of axially moving the first segments relative to the second segments further comprises sliding the first segments with respect to the second segments via a tongue-in-groove arrangement.

* * * * *